United States Patent [19]

Goldberg

[11] 4,061,338

[45] Dec. 6, 1977

[54] NOVELTY COIN FLIPPING DEVICE

[76] Inventor: Burton D. Goldberg, 15109 Watergate Road, Silver Spring, Md. 20904

[21] Appl. No.: 684,259

[22] Filed: May 7, 1976

[51] Int. Cl.[2] ..... A63B 67/12

[52] U.S. Cl. ..... 273/138 R; 124/4; 273/96 R

[58] Field of Search ..... 273/101, 95 R, 96 R, 273/135 R, 138 R, 138 A, 142 R, 142 A, 142 D, 145 C, 145 CA, 144 R, 144 D; 124/4; 46/47

[56] References Cited

U.S. PATENT DOCUMENTS

| | | | |
|---|---|---|---|
| 943,343 | 12/1909 | Ericson | 273/101 X |
| 2,044,994 | 6/1936 | Pierce | 273/138 R |
| 2,571,405 | 10/1951 | Anthony | 273/138 R X |
| 3,033,568 | 5/1962 | Achterberg | 273/101 |
| 3,582,075 | 6/1971 | Glass | 124/4 X |
| 3,659,852 | 5/1972 | Redict | 273/145 C X |

OTHER PUBLICATIONS

*Popular Electronics;* "Heads or Tails"; June, 1961; pp. 51–53.

Roystoys, Inc.; Mar. 10, 1966.

*Primary Examiner*—Richard C. Pinkham
*Assistant Examiner*—Vance Y. Hum
*Attorney, Agent, or Firm*—Roylance, Abrams, Berdo & Kaul

[57] ABSTRACT

A novelty coin flipping device includes an upstanding tubular member, closed at the top, and having a pivotal operating lever with a coin support pad disposed adjacent the bottom. A coin is positioned within the tubular member and normally rests upon the support pad. When the lever is depressed, the disc is flipped upwardly within the tubular member to gravitationally descend, in either a "heads" or "tails" position, upon the support pad.

6 Claims, 2 Drawing Figures

NOVELTY COIN FLIPPING DEVICE

This invention relates to amusement devices and more particularly it relates to a novelty coin flipping device which can be used to cause a coin to flip in a random manner within a prescribed confined area and to end up in either a "heads" or "tails" position.

Almost since the advent of modern coinage, it has been common to flip a coin into the air and permit the same to gravitationally drop, either into the user's hand or onto a supporting surface, to see whether the coin will end up in the "heads" or "tails" position. Such coin flipping has been used for wagering purposes, for compromising disputes and for arriving at decisions. More recently, so-called "executive decision makers" have been provided, such devices being in the form of electronic units which dispense with the need for the coin and which produce a random signal which activates either a "heads" or a "tails" indicator, in a random fashion.

The present invention has as its objective the provision of a coin flipping device which actually uses a coin and wherein the coin is visible before, during and after the flipping operation. Also, the objective of the present invention is to provide such a device in the form of a compact unit which can be used as a game or toy or which can also be used as a decorative item for a desk, coffee table or the like.

The objectives of the foregoing invention are attained by providing an upstanding transparent tubular member, preferably cylindrical in configuration, supported at its lower end upon a base and closed at its upper end by a cover. A pivotal operating lever is used in conjunction with the upstanding member, such operating lever having a coin support pad mounted on the inner end thereof, with the coin support pad being disposed adjacent the bottom of the tubular member. A coin normally rests upon the support pad, but when the lever is depressed, the coin is flipped upwardly through the tubular member in such a fashion that the coin rotates from a "heads" position to a "tails" position and back to a "heads " position, and so on. Naturally, the upper limit of travel of the coin is determined by its contact against the cover. After the coin reaches its upper limit, it gravitationally drops back through the tube and comes to rest upon the support pad in either a "heads" or a "tails" position. In order to assure that the coin will flip over during its upward transit through the tubular member, the support pad and hence the coin is disposed angularly at its normal rest position. At least the tubular member and advantageously the whole device is formed of transparent material, such as transparent plastic, to enable the coin to be visually observed at all times.

Figure 1:
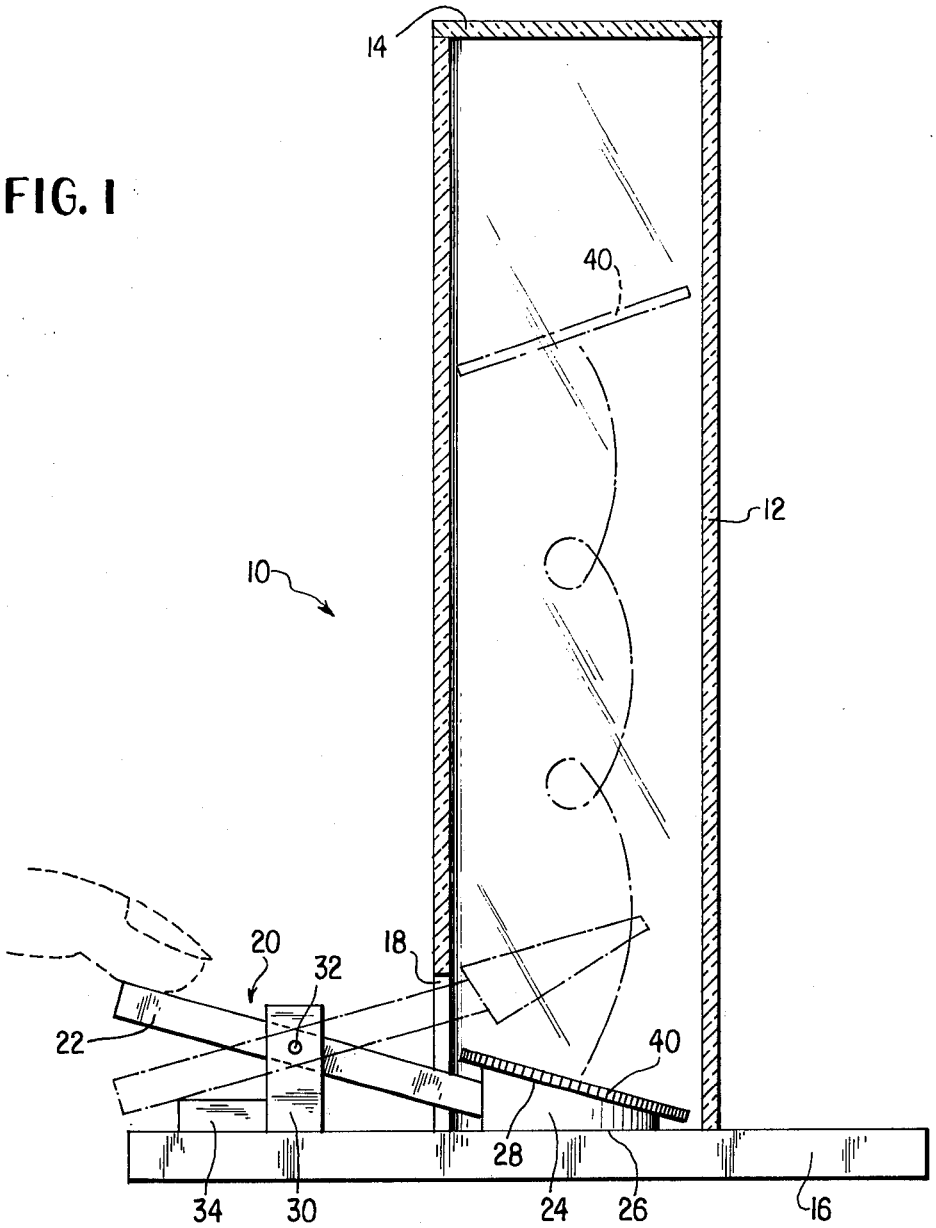
Figure 2:
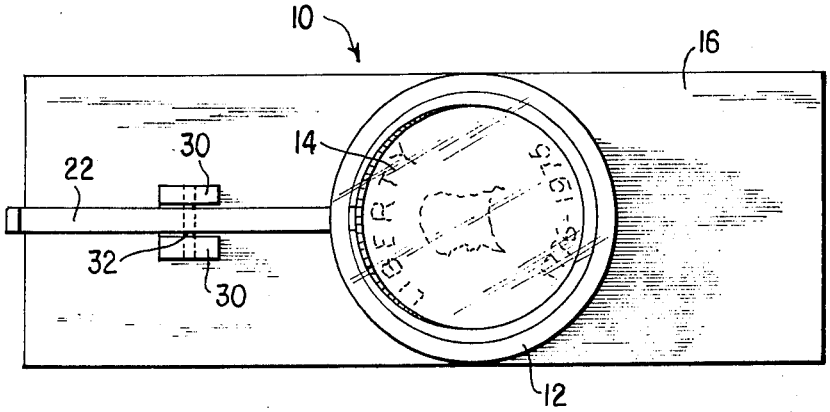

Referring now to the drawings which form a part of this original disclosure:

FIG. 1 is a side elevational view of a novelty coin flipping device in accordance with the present invention, with the tubular member thereof being shown in cross section; and FIG. 2 is a top plan view thereof.

Referring now to the drawings in further detail, the novelty coin flipping device of the present invention is generally designated 10. It includes an upstanding transparent tubular member 12 which is advantageously formed of transparent plastic. The tubular member 12 is preferably a right cylinder, as illustrated, and hence is circular in cross sectional configuration. A cover 14 in the form of a circular plate is adhered to the upper end of the tubular member 12 for the purpose of closing the same.

The tubular member 12 is mounted upon a support base 16 which serves as a stand to permit the device 10 to be positioned in an upstanding manner upon any horizontal supporting surface, such as a desk, coffee table or the like.

The tubular member 12 is provided with a vertical slit 18 which extends vertically upward from the base for a short distance. The purpose for this slit 18 is to permit passage of the pivotal operating lever of the present invention, which lever is generally designated 20. The pivotal operating lever 20 includes an elongated bar or rod 22 having a portion which projects through the slit 18 and into the bottom of the tubular member 12. On this inward projecting portion, a coin support pad 24 is positioned. The pad includes a lower surface 26 which normally abuts against and rests upon the top of the base 16. The coin support pad 24 also includes an upper surface 28 upon which the coin normally rests. This coin support surface 28 is disposed at an acute angle with the base 16 thus serving to assure that the coin, at its rest position, will be disposed at an acute angle rather than in a horizontal position.

Lever support means are provided on the base adjacent to the tubular member 12. Such lever support means includes a pair of spaced upstanding support arms 30, between which the lever bar 22 extends. A pivot pin 32 extends through the support arms and the lever, thus mounting the lever for pivotal movement. That portion of the lever 22 which extends outboard of the pivot pin 32 provides a digitally engageable portion, adapted to be contacted and depressed by a user's finger as illustrated in FIG. 1. A stop member 34 is provided on the base, adjacent to the support arms 30, to provide a limit means which halts downward movement of the lever 22. A coin 40 is disposed within the tubular member 12 and at its normal rest position, the coin is supported upon the surface 28 of the coin support pad 24. It is preferred that the diameter of the tubular member 12 be no more than 25 percent larger than the diameter of the coin 40 to thus assure that the walls of the tubular member 12 will serve as a guide for the upward and downward transit of the coin.

When the lever 22 is digitally depressed into contact with the stop 34, the coin support pad is pivoted upwardly, as shown in phantom lines in FIG. 1. This movement, in turn, causes the coin 40 to flip upwardly within the confines of the transparent tubular member 12. The maximum upward travel of the coin 40 is, of course, limited by the location of the cover 14. Normally the height of the tubular member, and hence the positioning of the cover 14, will be from 4 to 8 times the diameter of the coin 40. When the coin 40 flips upward, and because it is starting from an angularly disposed position, the coin will flip over and over from its "heads" position to its "tails" position and back to its "heads" position during the time that the coin continues to rise in the tubular member. When the coin reaches the apex of its travel, it gravitationally descends through the tube and drops onto the coin support pad, ending up either in a "heads" or a "tails" position. Thus, as can be seen, through simple depressing of a digitally operated lever, it is possible to flip the coin upwardly through the tubular member and have it end up in a random "heads" or "tails" position.

The novelty device of the present invention not only serves as an efficient and effective coin flipping device, by additionally, provides a unique and attractive display item. The coin is housed within the member itself and is not capable of being contacted in any way by the user's hands or fingers.

The term "coin" as used herein is intended to comprehend not only currency but also to include any disc which bears indicia signifying "heads" on one surface and "tails" on the reverse surface.

Various changes and modifications apparent to those skilled in the art may be made in connection with the device described herein without departing from the spirit and scope of my invention as defined in the appended claims.

What is claimed is:

1. A novelty coin flipping device comprising:

an upstanding transparent tubular member having a substantially circular cross-section;

said tubular member having a cover member closing the upper end thereof;

a pivotal operating lever having a coin support pad thereon, said coin support pad being disposed adjacent the bottom of said tubular member; and a circular coin disposed in said tubular member, said coin normally resting upon said support pad;

said operating lever being digitally operable to flip said coin upward within said tubular member;

said coin, when flipped upward, rising within said tubular member and then gravitationally dropping therein to come to rest in either a "heads" or a "tails" position upon said support pad.

2. A novelty coin flipping device as defined in claim 1 further including a support base upon which said tubular member is mounted.

3. A novelty coin flipping device as defined in claim 2 wherein coin support pad is disposed at an acute angle with respect to said base whereby said coin normally is disposed angularly within said tubular member.

4. A novelty coin flipping device as defined in claim 3 wherein said tubular member has a vertical slit therein extending upward from said base and wherein said lever projects through said slit to provide a digitally engageable portion.

5. A novelty coin flipping device as defined in claim 4 further including lever support means positioned on said base adjacent to said tubular member and adjacent to said digitally engageable portion of said lever, and pivot means connected between said lever and said lever support means.

6. A novelty coin flipping device as defined in claim 1 wherein the diameter of said tubular member is no more than 25 percent greater than the diameter of said coin.

* * * * *